US010584570B2

(12) United States Patent
Cheng et al.

(10) Patent No.: US 10,584,570 B2
(45) Date of Patent: Mar. 10, 2020

(54) INTERACTIVELY PLANNING A WELL SITE

(71) Applicants: Yao-Chou Cheng, Houston, TX (US); Ruben D. Uribe, Humble, TX (US); Doug H. Freeman, Spring, TX (US); Christopher A. Alba, Willis, TX (US); Jose J. Sequeira, Jr., The Woodlands, TX (US)

(72) Inventors: Yao-Chou Cheng, Houston, TX (US); Ruben D. Uribe, Humble, TX (US); Doug H. Freeman, Spring, TX (US); Christopher A. Alba, Willis, TX (US); Jose J. Sequeira, Jr., The Woodlands, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 737 days.

(21) Appl. No.: 14/286,206

(22) Filed: May 23, 2014

(65) Prior Publication Data

US 2014/0365192 A1 Dec. 11, 2014

Related U.S. Application Data

(60) Provisional application No. 61/833,159, filed on Jun. 10, 2013.

(51) Int. Cl.
*E21B 43/30* (2006.01)
*E21B 41/00* (2006.01)

(52) U.S. Cl.
CPC ..... *E21B 43/30* (2013.01); *E21B 41/00* (2013.01)

(58) Field of Classification Search
CPC ..... E21B 43/30; E21B 41/00
See application file for complete search history.

(56) References Cited

U.S. PATENT DOCUMENTS 4,794,534 A 12/1988 Millheim
5,468,088 A 11/1995 Shoemaker et al.
(Continued)

FOREIGN PATENT DOCUMENTS

CA 2312381 6/1999
EP 1036341 11/1998
(Continued)

OTHER PUBLICATIONS

Cabral, B., et al (1995), "Accelerated Volume Rendering and Tomographic Reconstruction Using Texture Mapping Hardware", *IEEE in Symposium on Volume Visualization,* pp. 91-98, 131.
(Continued)

*Primary Examiner* — Rehana Perveen
*Assistant Examiner* — Steven W Crabb
(74) *Attorney, Agent, or Firm* — ExxonMobil Upstream Research Company—Law Department

(57) ABSTRACT

A method and systems for dynamically planning a well site are provided herein. The method includes generating, via a computing system, a three-dimensional model of a hydrocarbon field including a reservoir. The method also includes determining a location for a well site based on the three-dimensional model and determining reservoir targets for the determined location and a well trajectory for each reservoir target. The method also includes adjusting the location for the well site within the three-dimensional model and dynamically adjusting the reservoir targets and the well trajectories based on the dynamic adjustment of the location for the well site. The determination and the dynamic adjustment of the location, the reservoir targets, and the well trajectories for the well site are based on specified constraints. The method further includes determining a design for the well site based on the dynamic adjustment of the
(Continued)

location, the reservoir targets, and the well trajectories for the well site.

8 Claims, 12 Drawing Sheets

(56) References Cited

U.S. PATENT DOCUMENTS 5,708,764 A 1/1998 Borrel et al.
5,905,657 A 5/1999 Celniker
5,992,519 A 11/1999 Ramakrishman et al.
6,002,985 A 12/1999 Stephenson
6,035,255 A 3/2000 Murphy et al.
6,044,328 A 3/2000 Murphy et al.
6,049,758 A 4/2000 Bunks et al.
6,070,125 A 5/2000 Murphy et al.
6,101,447 A 8/2000 Poe, Jr.
6,219,061 B1 4/2001 Lauer et al.
6,236,942 B1 5/2001 Bush
6,236,994 B1 5/2001 Swartz et al.
6,353,677 B1 3/2002 Pfister et al.
6,373,489 B1 4/2002 Lu et al.
6,438,069 B1 8/2002 Ross et al.
6,490,528 B2 12/2002 Cheng et al.
6,516,274 B2 2/2003 Cheng et al.
6,519,568 B1 2/2003 Harvey et al.
6,529,833 B2 3/2003 Fanini et al.
6,549,854 B1 4/2003 Malinverno et al.
6,549,879 B1 4/2003 Cullick et al.
6,606,101 B1 * 8/2003 Malamud ..... G06F 3/04812 345/473
6,612,382 B2 9/2003 King
6,643,656 B2 11/2003 Peterson
6,715,551 B2 4/2004 Curtis et al.
6,757,613 B2 6/2004 Chapman et al.
6,765,570 B1 7/2004 Cheung et al.
6,766,254 B1 7/2004 Bradford et al.
6,772,066 B2 8/2004 Cook
6,823,266 B2 11/2004 Czernuszenko et al.
6,826,483 B1 11/2004 Anderson et al.
6,823,732 B2 12/2004 Haarstad
6,829,570 B1 12/2004 Thambynayagam et al.
6,912,467 B2 6/2005 Schuette
6,912,468 B2 6/2005 Marin et al.
6,978,210 B1 12/2005 Suter et al.
6,980,939 B2 12/2005 Dhir et al.
6,980,940 B1 12/2005 Gurpinar et al.
6,993,434 B2 1/2006 Cheng et al.
7,003,439 B2 2/2006 Aldred et al.
7,027,925 B2 4/2006 Terentyev et al.
7,031,842 B1 4/2006 Musat et al.
7,035,255 B2 4/2006 Tzeng
7,047,170 B2 5/2006 Feldman et al.
7,050,953 B2 5/2006 Chiang et al.
7,054,752 B2 5/2006 Zabalza-Mezghani et al.
7,079,953 B2 7/2006 Thorne et al.
7,085,696 B2 8/2006 King
7,089,167 B2 8/2006 Poe
7,096,172 B2 8/2006 Colvin et al.
7,098,908 B2 8/2006 Acosta et al.
7,109,717 B2 9/2006 Constable
7,136,064 B2 11/2006 Zuiderveld
7,181,380 B2 2/2007 Dusterhoft et al.
7,200,540 B2 * 4/2007 Colvin ..... E21B 7/00 166/312
7,203,342 B2 4/2007 Pedersen
7,225,078 B2 5/2007 Shelley et al.
7,248,258 B2 7/2007 Acosta et al.
7,278,496 B2 10/2007 Leuchtenberg
7,280,932 B2 10/2007 Zoraster et al.
7,281,213 B2 10/2007 Callegari
7,283,941 B2 10/2007 Horowitz et al.
7,298,376 B2 11/2007 Chuter
7,314,588 B2 1/2008 Blankenship
7,328,107 B2 2/2008 Strack et al.
7,330,791 B2 2/2008 Kim et al.
7,337,067 B2 2/2008 Sanstrom
7,340,347 B2 3/2008 Shray et al.
7,343,275 B2 3/2008 Lenormand et al.
7,362,329 B2 4/2008 Zuiderveld
7,363,866 B2 4/2008 Gnedenko et al.
7,366,616 B2 4/2008 Bennett et al.
7,367,411 B2 5/2008 Leuchtenberg
7,395,252 B2 7/2008 Anderson et al.
7,409,438 B2 8/2008 McConnell et al.
7,412,363 B2 8/2008 Callegari
7,437,358 B2 10/2008 Arrouye et al.
7,451,066 B2 11/2008 Edwards et al.
7,458,062 B2 11/2008 Coulthard et al.
7,460,957 B2 12/2008 Prange et al.
7,478,024 B2 1/2009 Gurpinar et al.
7,512,543 B2 3/2009 Raghuraman et al.
7,519,976 B2 4/2009 Blevins
7,539,625 B2 5/2009 Klumpen et al.
7,548,873 B2 6/2009 Veeningen et al.
7,565,243 B2 7/2009 Kim et al.
7,576,740 B2 8/2009 Dicken
7,596,481 B2 9/2009 Zamora et al.
7,603,264 B2 10/2009 Zamora et al.
7,606,666 B2 10/2009 Repin et al.
7,616,213 B2 11/2009 Chuter
7,620,534 B2 11/2009 Pita et al.
7,627,430 B2 12/2009 Hawtin
7,630,914 B2 12/2009 Veeningen et al.
7,652,779 B2 1/2010 Wu et al.
7,657,407 B2 2/2010 Logan
7,657,414 B2 2/2010 Zamora et al.
7,657,494 B2 2/2010 Wilkinson et al.
7,668,700 B2 2/2010 Erignac et al.
7,672,826 B2 3/2010 Chen et al.
7,684,929 B2 3/2010 Prange et al.
7,711,550 B1 5/2010 Feinberg et al.
7,716,028 B2 5/2010 Montaron et al.
7,716,029 B2 5/2010 Couet et al.
7,725,302 B2 5/2010 Ayan et al.
7,739,089 B2 6/2010 Gurpinar et al.
7,743,006 B2 6/2010 Woronow et al.
7,752,022 B2 7/2010 Fornel et al.
7,778,811 B2 8/2010 Kelfoun
7,796,468 B2 9/2010 Kellogg
7,814,989 B2 10/2010 Nikolakis-Mouchas et al.
7,876,705 B2 1/2011 Gurpinar et al.
7,878,268 B2 2/2011 Chapman et al.
7,886,285 B2 2/2011 Asselin et al.
7,899,657 B2 3/2011 Martin
7,913,190 B2 3/2011 Grimaud et al.
7,925,483 B2 4/2011 Xia et al.
7,925,695 B2 4/2011 McConnell et al.
7,953,585 B2 5/2011 Gurpinar et al.
7,953,587 B2 5/2011 Bratton et al.
7,970,545 B2 6/2011 Sanstrom
7,986,319 B2 7/2011 Dommisse et al.
7,991,600 B2 8/2011 Callegari
7,995,057 B2 8/2011 Chuter
8,005,658 B2 8/2011 Tilke et al.
8,044,602 B2 10/2011 Smith
8,055,026 B2 11/2011 Pedersen
8,064,684 B2 11/2011 Ratti et al.
8,073,664 B2 12/2011 Schottle et al.
8,094,515 B2 1/2012 Miller et al.
8,103,493 B2 1/2012 Sagert et al.
8,145,464 B2 3/2012 Amegaard et al.
8,155,942 B2 4/2012 Sarma et al.
8,199,166 B2 6/2012 Repin et al.
8,204,728 B2 6/2012 Schottle et al.
8,249,844 B2 8/2012 Dale et al.
8,259,126 B2 9/2012 Chuter
8,280,635 B2 10/2012 Ella et al.
8,296,720 B2 10/2012 Coulthard et al.
8,301,426 B2 10/2012 Abasov et al.
8,325,179 B2 12/2012 Murray et al.
8,346,695 B2 1/2013 Pepper et al.
8,364,404 B2 1/2013 Legendre et al.
8,381,815 B2 2/2013 Karanikas et al.

(56) References Cited

U.S. PATENT DOCUMENTS 8,392,163 B2 3/2013 Liu
8,427,904 B2 4/2013 Miller et al.
8,560,476 B2 10/2013 Anderson et al.
8,578,000 B2 11/2013 Van Wie et al.
8,598,882 B2 12/2013 Meekes
8,638,328 B2 1/2014 Lin
8,727,017 B2 5/2014 Hilliard et al.
8,731,872 B2 5/2014 Czernuszenko et al.
8,731,873 B2 5/2014 Walker et al.
8,731,875 B2 5/2014 Hilliard et al.
8,736,600 B2 5/2014 Lin et al.
8,751,208 B2 6/2014 Brouwer et al.
8,797,319 B2 8/2014 Lin
8,803,878 B2 8/2014 Andersen et al.
8,812,334 B2 8/2014 Givens et al.
8,849,639 B2 9/2014 Brown et al.
8,849,640 B2 9/2014 Holl et al.
8,868,540 B2 10/2014 Ture et al.
8,884,964 B2 11/2014 Holl et al.
8,931,580 B2 1/2015 Cheng et al.
9,026,417 B2 5/2015 Sequeira, Jr. et al.
9,047,689 B2 6/2015 Stolte et al.
9,123,161 B2 9/2015 Adair et al.
2002/0049575 A1 4/2002 Jalali et al.
2002/0067373 A1 6/2002 Roe et al.
2002/0177955 A1 11/2002 Jalali et al.
2003/0072907 A1 4/2003 Lerner et al.
2003/0078794 A1 4/2003 Knapp
2004/0012670 A1 1/2004 Zhang
2004/0207652 A1 10/2004 Ratti et al.
2004/0268338 A1 12/2004 Gurpinar et al.
2005/0119959 A1 6/2005 Eder
2005/0120242 A1 6/2005 Mayer et al.
2005/0171700 A1 8/2005 Dean
2005/0199391 A1 9/2005 Cudmore et al.
2006/0085174 A1 4/2006 Hemanthkumar
2006/0224423 A1 10/2006 Sun et al.
2006/0247903 A1 11/2006 Schottle
2006/0265508 A1 11/2006 Angel et al.
2007/0076044 A1 4/2007 Corley, Jr. et al.
2007/0088707 A1 4/2007 Durgin et al.
2007/0100703 A1 5/2007 Noda
2007/0185696 A1 8/2007 Moran et al.
2007/0199721 A1 8/2007 Givens et al.
2007/0213935 A1 9/2007 Fagnou et al.
2007/0266082 A1 11/2007 McConnell et al.
2007/0294034 A1 12/2007 Bratton et al.
2008/0088621 A1 4/2008 Grimaud et al.
2008/0120076 A1 5/2008 Thambynayagam et al.
2008/0165185 A1 7/2008 Smith et al.
2008/0165186 A1 7/2008 Lin
2008/0243749 A1 10/2008 Pepper et al.
2008/0297510 A1 12/2008 Callegari
2008/0300793 A1* 12/2008 Tilke ..... E21B 43/30 702/13
2008/0306803 A1 12/2008 Vaal et al.
2009/0027380 A1 1/2009 Rajan et al.
2009/0027385 A1 1/2009 Smith
2009/0037114 A1 2/2009 Peng et al.
2009/0043507 A1 2/2009 Dommisse et al.
2009/0056935 A1* 3/2009 Prange ..... E21B 7/04 166/245
2009/0070086 A1 3/2009 LeRavalec et al.
2009/0089028 A1 4/2009 Sagert et al.
2009/0125362 A1 5/2009 Reid et al.
2009/0132170 A1 5/2009 Krueger et al.
2009/0157367 A1 6/2009 Meyer et al.
2009/0182541 A1 7/2009 Crick et al.
2009/0198447 A1 8/2009 Legendre et al.
2009/0205819 A1 8/2009 Dale et al.
2009/0222742 A1 9/2009 Pelton et al.
2009/0229819 A1 9/2009 Repin et al.
2009/0240564 A1 9/2009 Boerries et al.
2009/0295792 A1 12/2009 Liu et al.
2009/0299709 A1 12/2009 Liu
2009/0303233 A1 12/2009 Lin et al.
2009/0319243 A1 12/2009 Suarez-Rivera et al.
2010/0013831 A1 1/2010 Gilje et al.
2010/0053161 A1 3/2010 Chuter
2010/0132450 A1 6/2010 Pomerantz et al.
2010/0161292 A1 6/2010 Shook et al.
2010/0161300 A1 6/2010 Yeten et al.
2010/0169018 A1 7/2010 Brooks
2010/0171740 A1 7/2010 Andersen et al.
2010/0172209 A1 7/2010 Miller et al.
2010/0174489 A1 7/2010 Bryant et al.
2010/0179797 A1* 7/2010 Cullick ..... E21B 43/30 703/10
2010/0185395 A1 7/2010 Pirovolou et al.
2010/0191516 A1* 7/2010 Benish ..... E21B 43/00 703/10
2010/0206559 A1 8/2010 Sequeira, Jr. et al.
2010/0214870 A1 8/2010 Pepper et al.
2010/0225642 A1 9/2010 Murray et al.
2010/0271232 A1 10/2010 Clark et al.
2010/0283788 A1 11/2010 Rothnemer et al.
2010/0286917 A1 11/2010 Hazlett et al.
2010/0299125 A1 11/2010 Ding et al.
2010/0307742 A1 12/2010 Philips et al.
2011/0022435 A1 1/2011 Reid et al.
2011/0029293 A1 2/2011 Petty et al.
2011/0040533 A1 2/2011 Torrens et al.
2011/0040536 A1 2/2011 Levitan
2011/0044532 A1 2/2011 Holl et al.
2011/0054857 A1 3/2011 Moguchaya
2011/0060572 A1 3/2011 Brown et al.
2011/0063292 A1 3/2011 Holl et al.
2011/0074766 A1 3/2011 Page et al.
2011/0099547 A1 4/2011 Banga
2011/0106514 A1 5/2011 Omeragic et al.
2011/0107246 A1 5/2011 Vik
2011/0109633 A1 5/2011 Sequeira, Jr. et al.
2011/0112802 A1 5/2011 Wilson et al.
2011/0115787 A1 5/2011 Kadlee
2011/0126192 A1 5/2011 Frost et al.
2011/0153300 A1* 6/2011 Holl ..... E21B 47/022 703/10
2011/0157235 A1 6/2011 Fitzsimmons
2011/0161133 A1 6/2011 Staveley et al.
2011/0168391 A1 7/2011 Saleri et al.
2011/0175899 A1 7/2011 Bittar et al.
2012/0037359 A1* 2/2012 Schottle ..... E21B 7/06 166/245
2012/0137281 A1 5/2012 Kleiner et al.
2012/0150449 A1 6/2012 Dobin
2012/0166166 A1 6/2012 Czernuszenko
2013/0231901 A1* 9/2013 Lu ..... E21B 43/30 703/1
2013/0317798 A1 11/2013 Cheng et al.
2014/0365192 A1 12/2014 Cheng et al.
2015/0049084 A1 2/2015 Cheng et al.
2015/0094994 A1 4/2015 Sequeira, Jr. et al.
2016/0003008 A1 1/2016 Uribe et al.

FOREIGN PATENT DOCUMENTS

EP 1230566 11/2000
WO 2000/14574 3/2000
WO 2003/072907 9/2003
WO 2005/020044 3/2005
WO 2006/029121 3/2006
WO 2007/076044 7/2007
WO 2007/100703 9/2007
WO 2008/121950 10/2008
WO 2009/032416 3/2009
WO 2009/039422 3/2009
WO 2009/079160 6/2009
WO 2009/080711 7/2009
WO 2009/148681 12/2009
WO 2011/038221 3/2011

(56) References Cited

FOREIGN PATENT DOCUMENTS

| | | | | |
|---|---|---|---|---|
| WO | WO 2012027020 A1 * | 3/2012 | ..... | E21B 7/04 |
| WO | WO-2012115690 A1 * | 8/2012 | ..... | E21B 43/305 |

OTHER PUBLICATIONS

McCann, P., et al. (2003), "Horizontal Well Path Planning and Correction Using Optimization Techniques,"*J. of Energy Resources Tech.* 123, pp. 187-193.

Mugerin. C., et al. (2002), "Well Design Optimization: Implementation in GOCAD," 22$^{nd}$ Gocade Meeting, Jun. 2002.

Rainaud, J.F., et al. (2004), "WOG—Well Optimization by Geosteering: A Pilot Software for Cooperative Modeling on Internet," *Oil & Gas Science & Tech.* 59(4), pp. 427-445.

Reed, P., et al. (2003) "Simplifying Multiobjective Optimization Using Genetic Algorithms," Proceedings of World Water and Environmental Resources Congress, 10 pgs.

Udoh, E., et al. (2003), "Applications of Strategic Optimization Techniques to Development and Management of Oil and Gas Resources", 27$^{th}$ SPE Meeting, 16 pgs.

*European Search Report,* dated Jul. 19, 2009, EP 09150617.

*International Search Report and Written Opinion,* dated Aug. 17, 2009, PCT/US2009/049594.

Bharat, K, et al. (2001), "Who Links to Whom: Mining Linkage Between Web sites", *Proceedings of the 2001 IEE Int 'l Conf. on Data Mining,* pp. 51-58.

Crawfis, R., et al. (1992), "Direct Volume Visualization of Three-Dimensional Vector Fields", *Proceedings of the 1992 Workshop on Volume Visualization,* pp. 55-60.

Dhillon, S. (2008), "Managing License Incompatibilities Distributing Eclipse Application Stacks", Thesis, pp. 1-116.

Drebin, R., et al. (1988), "Volume Rendering", *Computer Graphics, the Proceedings of 1988 SIGGRAPH Conference,* vol. 22, No. 4, pp. 65-74.

Lorensen, W., et al., (1987), "Marching Cubes: A High-Resolution 3D Surface Construction Algorithm", *Computer Graphics, The Proceeding of 1987 SIGGRAPH Conference,* vol. 21, No. 4, pp. 163-169.

Yuen, B.B.W., et al. (2011) "Optimizing Development Well Placements Within Geological Uncertainty Utilizing Sector Models" SPE 148017. Paper prepared for presentation at the SPE Reservoir Characterization and Simulation Conference and Exhibition held in Abu Dhabi, UAE, Oct. 9-11, 2011.

* cited by examiner

100

200

204

300

400

410

420

500

516

600

700

800

INTERACTIVELY PLANNING A WELL SITE

CROSS-REFERENCE TO RELATED APPLICATION

This application claims the benefit of U.S. Provisional Patent Application 61/833,159 filed Jun. 10, 2013 entitled INTERACTIVELY PLANNING A WELL SITE, the entirety of which is incorporated by reference herein.

FIELD OF INVENTION

The present techniques relate generally to interactively planning a well site. More specifically, the present techniques provide for the interactive planning of a well site for recovering hydrocarbons from a reservoir based on a three-dimensional model of a hydrocarbon field including the reservoir.

BACKGROUND

This section is intended to introduce various aspects of the art, which may be associated with exemplary embodiments of the present techniques. This discussion is believed to assist in providing a framework to facilitate a better understanding of particular aspects of the present techniques. Accordingly, it should be understood that this section should be read in this light, and not necessarily as admissions of prior art.

The process of planning a well site for the development of a hydrocarbon field involves several discrete decisions. Specifically, the well site locations and the reservoir targets for the available slots in the drill center are selected. In addition, the trajectory of each well within the well site is planned such that certain engineering constraints are met. Such engineering constraints may relate to environmental issues, issues regarding the safe distance around the wells, issues regarding the costs of the facilities and the drilling process for the well site, or the like. For example, engineering constraints relating to environmental issues may specify that the well site location is to avoid certain obstacles, such as pipelines, roads, buildings, hazardous areas, environmentally protected areas, and the like. In addition, engineering constraints relating to issues regarding the safe distance around the wells may specify that the well site location is to be at least a specified distance away from existing wells to avoid potential collisions. Therefore, the main objective during the planning of a well site may be to maximize the total production output by selecting a suitable well site location and suitable reservoir targets, while meeting relevant engineering constraints and minimizing costs. However, planning a well site that meets this objective is often a complex and time-consuming process.

According to current techniques, a well site is planned and built as resources become available. First, a set of potential reservoir targets is selected. Second, a well site location is chosen at an appropriate surface location so that the horizontal reach to each reservoir target does not exceed a predefined distance. Third, the drill center for the well site is designed, and a set of well trajectories starting from the slots in the drill center are designed based on well path building algorithms and engineering constraints. However, according to such techniques, the user has to manually select the reservoir targets that are reachable from the slots in the drill center. Moreover, if the drill center has to be relocated to a different well site location, some of the previously selected reservoir targets may be more than the predefined horizontal distance from the well site location and, thus, may not meet the engineering constraints. In addition, some of the previously selected reservoir targets may not meet other engineering constraints, such as constraints relating to total measured depth, dogleg severity, or the like.

U.S. Pat. No. 6,549,879 to Cullick et al. describes a method for determining well locations in a three-dimensional reservoir model while satisfying various constraints. Such constraints include minimum inter-well spacing, maximum well length, angular limits for deviated completions, and minimum distance from reservoir and fluid boundaries. In the first stage, the wells are placed assuming that the wells can only be vertical. In the second stage, the vertical wells are examined for optimized horizontal and deviated completions. This process may be used to provide an initial set of well locations and configurations.

U.S. Pat. No. 7,096,172 to Colvin et al. describes a system and method for the automatic selection of targets for well placement using two-dimensional matrices that represent a three-dimensional model of the reservoir. Specifically, a number of values in a three-dimensional model are filtered to eliminate values that are below a threshold, and a first matrix that represents a two-dimensional model of the reservoir is developed based on values in the three-dimensional model. A second matrix is then developed from the first matrix using a distance-weighted sum of the values, and target locations are selected from the second matrix based on the distance-weighted sum of the values.

U.S. Patent Application Publication No. US 2008/0300793 by Tilke et al. describes a hybrid evolutionary algorithm technique for automatically calculating well and drainage locations in a hydrocarbon field. The hybrid evolutionary algorithm technique includes planning a set of wells for a static reservoir model using an automated well planner tool, and then selecting a subset of the wells based on dynamic flow simulation using a cost function that maximizes recovery or economic benefit.

U.S. Patent Application Publication No. US 2010/0125349 by Abasov et al. describes a system and method for developing a plan for multiple wellbores with a reservoir simulator based on actual and potential reservoir performance. Connected grid cells in a gridded reservoir model that meet particular criteria are identified, and a drainable volume indicator is created for each group of connected grid cells. An adjustment value for each drainable volume is calculated, and each drainable volume that has an adjustment value up to a predetermined maximum adjustment value is designated as a completion interval grid. Contiguous completion interval grids are then connected to form one or more completion intervals.

All of the techniques described above provide for the planning of a well site. However, such techniques do not provide flexibility during the planning process but, rather, automatically plan the well site based on predefined conditions. However, in many cases, it may be desirable to provide a dynamic well site planning process that responds to user interaction.

SUMMARY

An exemplary embodiment provides a method for dynamically planning a well site. The method includes generating, via a computing system, a three-dimensional model of a hydrocarbon field including a reservoir. The method also includes determining a location for a well site based on the three-dimensional model and determining reservoir targets for the determined location and a well trajectory for each reservoir target. The method also includes dynamically adjusting the location for the well site based on the three-dimensional model and dynamically adjusting the reservoir targets and the well trajectories based on the dynamic adjustment of the location for the well site. The determination and the dynamic adjustment of the location, the reservoir targets, and the well trajectories for the well site are based on specified constraints. The method further includes determining a design for the well site based on the dynamic adjustment of the location, the reservoir targets, and the well trajectories for the well site.

Another exemplary embodiment provides a computing system for dynamically planning a well site. The computing system includes a processor and a storage medium. The storage medium includes a three-dimensional model of a hydrocarbon field including a reservoir and specified constraints for planning a well site at the hydrocarbon field. The computing system also includes a non-transitory, computer-readable medium including code configured to direct the processor to dynamically determine a location for the well site based on the three-dimensional model and the specified constraints in response to feedback from a user of the computing system, and dynamically determine reservoir targets for the well site based on the three-dimensional model and the specified constraints in response to the dynamic determination of the location for the well site. The non-transitory, computer-readable medium also includes code configured to direct the processor to dynamically determine a well trajectory for each reservoir target based on the three-dimensional model and the specified constraints, and determine a design for the well site based on the dynamic determination of the location, the reservoir targets, and the well trajectories for the well site in response to feedback from the user.

Another exemplary embodiment provides a non-transitory, computer-readable storage medium for storing computer-readable instructions. The computer-readable instructions include code configured to direct a processor to generate a three-dimensional model of a hydrocarbon field including a reservoir and display the three-dimensional model to a user via a display device. The computer-readable instructions also include code configured to direct the processor to determine a location for a well site based on the three-dimensional model in response to feedback from a user, automatically determine reservoir targets for the determined location based on a drill center of a specified configuration, and automatically determine a well trajectory for each reservoir target. The computer-readable instructions also include code configured to direct the processor to dynamically update the location for the well site based on the three-dimensional model in response to feedback from the user and automatically update the reservoir targets and the well trajectories as the location for the well site is dynamically updated. The location, the reservoir targets, and the well trajectories for the well site are determined and updated based, at least in part, on specified constraints. The computer-readable instructions further include code configured to direct the processor to determine a design for the well site based on the determination and updating of the location, the reservoir targets, and the well trajectories for the well site.

BRIEF DESCRIPTION OF THE DRAWINGS

The advantages of the present techniques are better understood by referring to the following detailed description and the attached drawings, in which.

DETAILED DESCRIPTION

Figure 1:
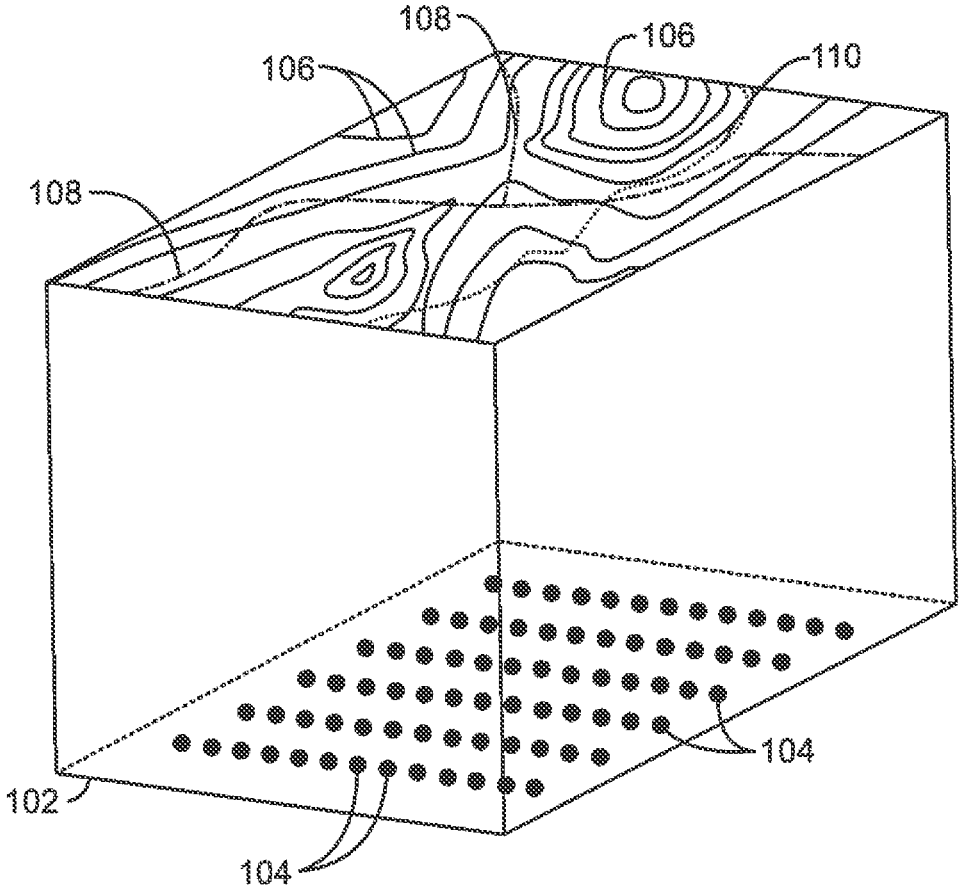
FIG. 1 is a schematic of a hydrocarbon field including a number of potential reservoir targets for the production of hydrocarbons.

In the following detailed description section, specific embodiments of the present techniques are described. However, to the extent that the following description is specific to a particular embodiment or a particular use of the present techniques, this is intended to be for exemplary purposes only and simply provides a description of the exemplary embodiments. Accordingly, the techniques are not limited to the specific embodiments described below, but rather, include all alternatives, modifications, and equivalents falling within the true spirit and scope of the appended claims.

At the outset, for ease of reference, certain terms used in this application and their meanings as used in this context are set forth. To the extent a term used herein is not defined below, it should be given the broadest definition persons in the pertinent art have given that term as reflected in at least one printed publication or issued patent. Further, the present techniques are not limited by the usage of the terms shown below, as all equivalents, synonyms, new developments, and terms or techniques that serve the same or a similar purpose are considered to be within the scope of the present claims.

The term "azimuth" describes the rotation of a device about an axis of a trajectory, relative to a reference that may be a projection of the gravity or magnetic field vector on a plane perpendicular to the axis.

The term "depth" describes a measure of displacement of a device along a trajectory.

"Dogleg severity" refers to the rate of change in degrees of a wellbore from vertical during drilling of the wellbore. Dogleg severity is often measured in degrees per one hundred feet (°/100 ft).

As used herein, "dynamic" and "dynamically" refer to automatically adjusting parameters in a simulation as a user changes other parameters and displaying the changes in a real-time fashion to allow the user to see the automatically adjusted parameters. This may be considered an interactive process, in which the user and the simulation interact to generate the final results.

The term "gas" is used interchangeably with "vapor," and is defined as a substance or mixture of substances in the gaseous state as distinguished from the liquid or solid state. Likewise, the term "liquid" means a substance or mixture of substances in the liquid state as distinguished from the gas or solid state.

A "geologic model" is a computer-based representation of a subsurface earth volume, such as a petroleum reservoir or a depositional basin. Geologic models may take on many different forms. Depending on the context, descriptive or static geologic models built for petroleum applications can be in the form of a three-dimensional array of cells, to which geologic and/or geophysical properties such as lithology, porosity, acoustic impedance, permeability, or water saturation are assigned. Many geologic models are constrained by stratigraphic or structural surfaces (for example, flooding surfaces, sequence interfaces, fluid contacts, faults) and boundaries (for example, facies changes). These surfaces and boundaries define regions within the model that possibly have different reservoir properties.

A "hydrocarbon" is an organic compound that primarily includes the elements hydrogen and carbon, although nitrogen, sulfur, oxygen, metals, or any number of other elements may be present in small amounts. As used herein, hydrocarbons generally refer to components found in natural gas, oil, or chemical processing facilities.

"Natural gas" refers to a multi-component gas obtained from a crude oil well or from a subterranean gas-bearing formation. The composition and pressure of natural gas can vary significantly. A typical natural gas stream contains methane ($CH_4$) as a major component, i.e., greater than 50 mol % of the natural gas stream is methane. The natural gas stream can also contain ethane ($C_2H_6$), higher molecular weight hydrocarbons (e.g., $C_3$-$C_{20}$ hydrocarbons), one or more acid gases (e.g., carbon dioxide or hydrogen sulfide), or any combinations thereof. The natural gas can also contain minor amounts of contaminants such as water, nitrogen, iron sulfide, wax, crude oil, or any combinations thereof. The natural gas stream may be substantially purified prior to use in embodiments, so as to remove compounds that may act as poisons.

"Permeability" is the capacity of a rock to transmit fluids through the interconnected pore spaces of the rock. Permeability may be measured using Darcy's Law: $Q=(k\Delta P A)/\mu L)$, wherein Q=flow rate ($cm^3/s$), $\Delta P$=pressure drop (atm) across a cylinder having a length L (cm) and a cross-sectional area A ($cm^2$), $\mu$=fluid viscosity (cp), and k=permeability (Darcy). The customary unit of measurement for permeability is the millidarcy.

"Porosity" is defined as the ratio of the volume of pore space to the total bulk volume of the material expressed in percent. Porosity is a measure of the reservoir rock's storage capacity for fluids. Porosity is preferably determined from cores, sonic logs, density logs, neutron logs or resistivity logs. Total or absolute porosity includes all the pore spaces, whereas effective porosity includes only the interconnected pores and corresponds to the pore volume available for depletion.

A "reservoir" is a subsurface rock formation from which a production fluid can be harvested. The rock formation may include granite, silica, carbonates, clays, and organic matter, such as oil, gas, or coal, among others. Reservoirs can vary in thickness from less than one foot (0.3048 meters) to hundreds of feet (hundreds of meters). The permeability of the reservoir provides the potential for production.

"Substantial" when used in reference to a quantity or amount of a material, or a specific characteristic thereof, refers to an amount that is sufficient to provide an effect that the material or characteristic was intended to provide. The exact degree of deviation allowable may depend, in some cases, on the specific context.

A "wellbore" is a hole in the subsurface made by drilling or inserting a conduit into the subsurface. A wellbore may have a substantially circular cross section or any other cross-sectional shape, such as an oval, a square, a rectangle, a triangle, or other regular or irregular shapes. As used herein, the term "well" may refer to the entire hole from the drill center at the surface to the toe or end in the formation. A well is generally configured to convey fluids to and from a subsurface formation.

Overview

Embodiments described herein provide for the interactive planning of a well site including a number of production wells for recovering hydrocarbons from a hydrocarbon field. More specifically, embodiments described herein provide for the planning of a well site in a dynamic, interactive manner using a three-dimensional model of a hydrocarbon field. The three-dimensional model may allow for the interactive determination of a suitable well site location, as well as a number of suitable reservoir targets and corresponding well trajectories. The three-dimensional model may include any suitable type of three-dimensional representation of a hydrocarbon reservoir, as well as the surrounding geologic structures, topography, and surface features.

The interactive well site planning process described herein may allow users of a computing system to dynamically test multiple scenarios for a well site prior to building an actual well site. For example, the dynamic well site planning process described herein may enable users to rapidly evaluate an entire hydrocarbon field to generate a suitable well site plan via the dynamic selection of well site locations, reservoir targets, and well trajectories. This may result in a minimization of the total cost of the well site planning process.

Three-Dimensional Models and Structures for Planning a Well Site

FIG. 1 is a schematic of a three-dimensional model 100 of a hydrocarbon field 102 including a number of potential reservoir targets 104 for the production of hydrocarbons. The three-dimensional model 100 may be generated by a computing system based on a survey of the hydrocarbon field 102 and surrounding area that is conducted as a first stage of the well site planning process. In addition to the potential reservoir targets 104, the three-dimensional model 100 may include representations of the surface features near the hydrocarbon field 102 that were identified during the survey of the hydrocarbon field 102. Specifically, the three-dimensional model may be a combination of a geologic model including a three-dimensional array of cells showing the hydrocarbon reservoir and surrounding geologic structures, and a three-dimensional surface model including the topology and surface features of the area near the hydrocarbon reservoir. For example, the three-dimensional model 100 may include contour lines 106 that represent the topology of the surface, dashed lines 108 that represent roads, and dotted lines 110 that represent underground pipelines near the hydrocarbon field 102.

The reservoir targets 104 identified during the survey may indicate target areas that are reachable via production wells drilled from a well site location. In addition, the surface features identified during the survey may be used to indicate areas or objects to be avoided during the planning of the well site location and well trajectories. Such areas or objects to be avoided may include roads, underground pipelines, mountains, steep slopes, man-made structures, and the like. In various embodiments, the well site location is selected such that the well site is at least a minimum distance away from the surface features that were identified during the survey of the hydrocarbon field 102. Further, the well site location may be selected such that certain engineering constraints are met, as discussed further herein.

Figure 2A:
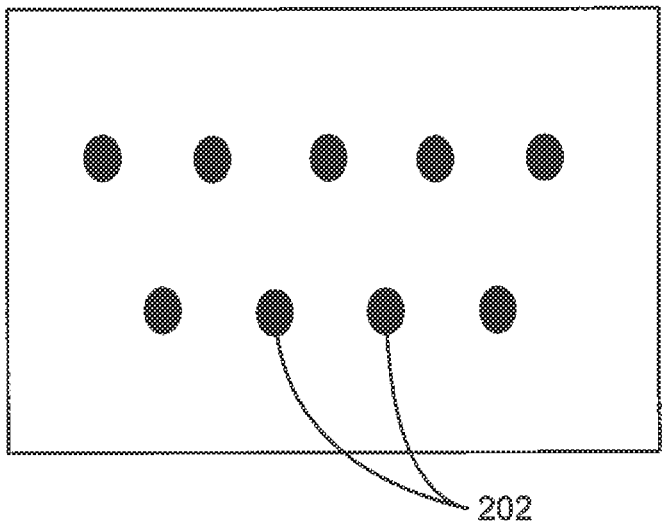
FIG. 2A is a schematic showing an exemplary configuration of a drill center for a well site.

FIG. 2A is a schematic showing an exemplary configuration of a drill center 200 for a well site. The drill center 200 shown in FIG. 2A includes nine slots 202 with a zero degree azimuth for the drill center direction. In some embodiments, the configuration of the drill center 200 for a well site is determined prior to the selection of the final well site location and reservoir targets.

Relevant engineering constraints, such as constraints relating to the maximum horizontal reach to the reservoir targets and constraints relating to the minimum distance to the ground objects to be avoided, may be taken into account during the determination of the drill center configuration for a well site. In addition, the available slots from existing drill centers may be taken into account during the determination of the drill center configuration for a well site.

Figure 2B:
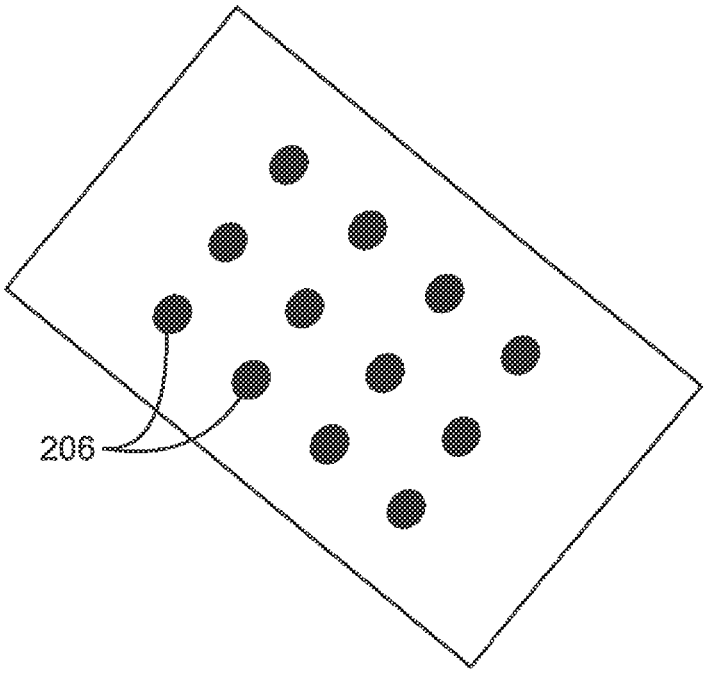
FIG. 2B is a schematic showing another exemplary configuration of a drill center for a well site.

FIG. 2B is a schematic showing another exemplary configuration of a drill center 204 for a well site. The drill center 204 shown in FIG. 2B includes twelve slots 206 in a three by four slot configuration with a forty-five degree azimuth for the drill center direction.

Based on the determined drill center configuration for a well site, a number of reservoir targets are selected, and a reservoir target is assigned to each slot in the drill center. The reservoir targets may be selected and assigned to the slots in the drill center automatically by the computing system, or manually in response to feedback from the user of the computing system. A suitable well trajectory is then constructed for each reservoir target, starting from the corresponding slot in the drill center. In various embodiments, the well-trajectory generation process is deterministic and is based on a number of constraints that are specified by the user. Further, in some embodiments, optimization algorithms are used to help derive suitable well trajectories for the reservoir targets.

Each well trajectory typically includes a sequence of straight and curved segments. The straight segments are less costly than the curved sections. However, the curved sections are used for transitioning from one azimuth direction to another to reach deviated locations.

Figure 3:
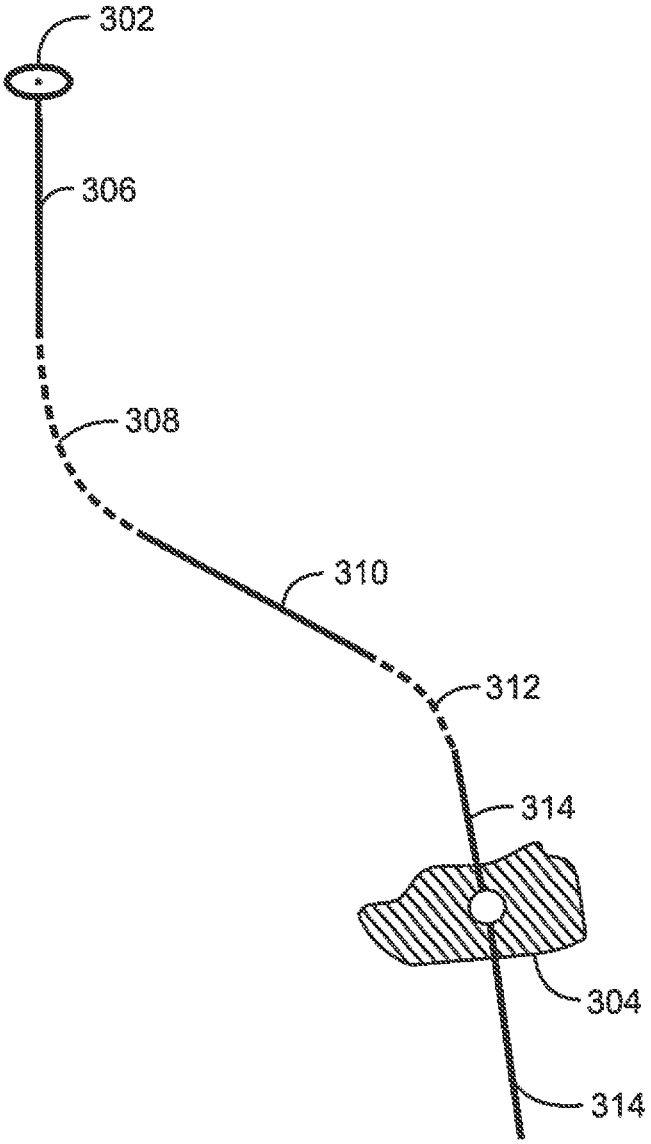
FIG. 3 is a schematic of a deviated well trajectory that may extend from a slot in the drill center to a specified reservoir target.

FIG. 3 is a schematic of a deviated well trajectory 300 that may extend from a slot 302 in the drill center to a specified reservoir target 304. The deviated well trajectory 300 may include an initial hold segment 306, followed by a first curved segment 308, a straight segment 310, a second curve segment 312, and a last hold segment 314 that extends past the specified reservoir target 304.

The well trajectory 300 shown in FIG. 3 may be deviated to reach the specified reservoir target 304 from the drill center slot 302, or may be deviated to meet certain engineering constraints. For example, the well trajectory 300 may be deviated to meet anti-collision constraints. Such anti-collision constraints may ensure that the well is at least a specified distance from identified geologic objects, such as faults. In addition, such anti-collision constraints may ensure that all well trajectories are at least a specified distance from one another. Additional engineering constraints that are to be met by the well trajectory 300, such as constraints relating to reservoir quality (e.g., porosity), minimum total measured depth, dogleg severity, and the like, may be predefined or input by the user. Further, although the well trajectory of the last hold segment 314 is shown as nearly vertical at the specified reservoir target 304, in various embodiments, the well trajectory may be nearly horizontal when intersecting the specified reservoir target 304. In some embodiments, multiple reservoir targets 304 may be intersected by a single horizontal well segment.

Figure 4A:
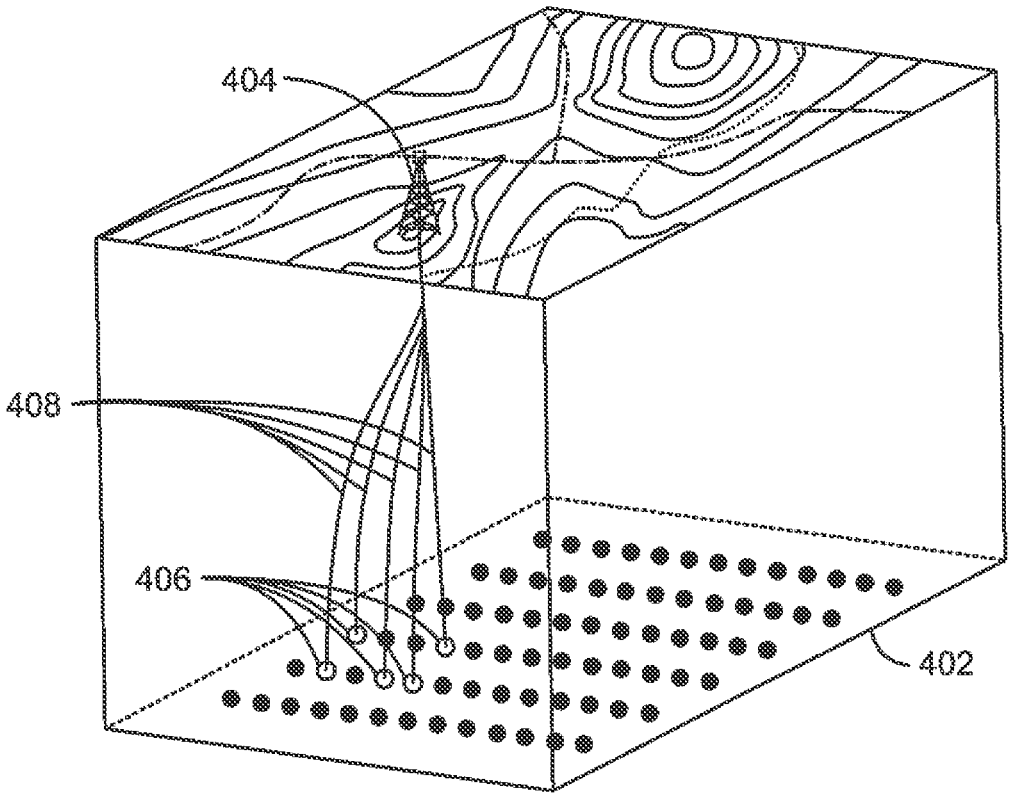
FIG. 4A is a schematic of a three-dimensional model of a hydrocarbon field including an initial well site that may be generated according to embodiments described herein.

FIG. 4A is a schematic of a three-dimensional model 400 of a hydrocarbon field 402 including an initial well site 404 that may be generated according to embodiments described herein. Once the well site location has been determined, a number of reservoir targets 406 may be automatically selected such that certain engineering constraints are met. For example, the reservoir targets 406 may be selected such that the horizontal reach from the well site 404 to each reservoir target 406 does not exceed a predefined distance. Further, a well trajectory 408 may be determined for each reservoir target 406 such that certain engineering constraints are met.

Figure 4B:
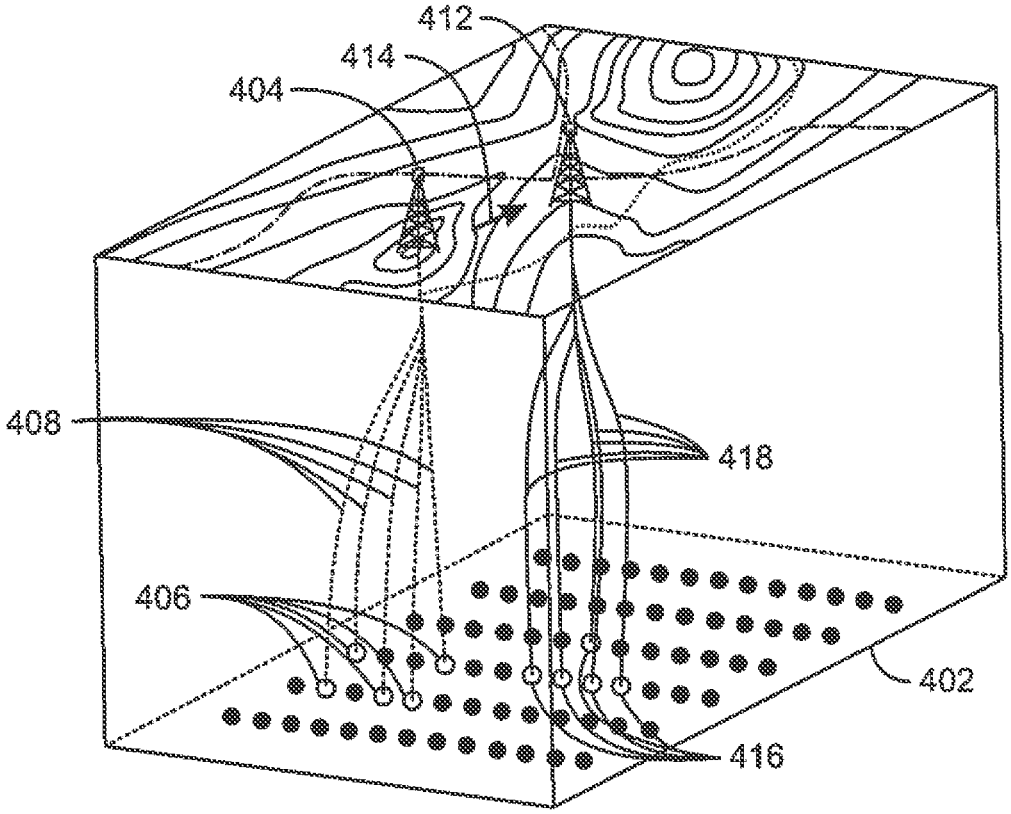
FIG. 4B is a schematic of a three-dimensional model of the hydrocarbon field including an alternative well site that may be generated instead of the initial well site according to embodiments described herein.

FIG. 4B is a schematic of a three-dimensional model 410 of the hydrocarbon field 402 including an alternative well site 412 that may be generated instead of the initial well site 404 according to embodiments described herein. Like numbered items are as described with respect to FIG. 4A. As indicated by arrow 414, once the initial well site 404 has been designated, the user may opt to move the drill center location to another suitable surface area. In some embodiments, the user may move the drill center location in response to changes in the planning conditions or applicable engineering constraints. In other embodiments, the user may move the drill center location to interactively test multiple scenarios for a well site prior to building the actual well site.

At the newly selected drill center location, the previously selected reservoir targets 406 may be released, and new reservoir targets 416 may be automatically selected. In addition, a new well trajectory 418 may be determined for each new reservoir target 416 such that the engineering constraints are met. In various embodiments, the dynamic selection of reservoir targets and well trajectories for each selected drill center location allows the user to rapidly evaluate and compare the costs and benefits of each well site plan. This may allow the user to quickly derive a suitable well site at a relatively low cost.

Figure 4C:
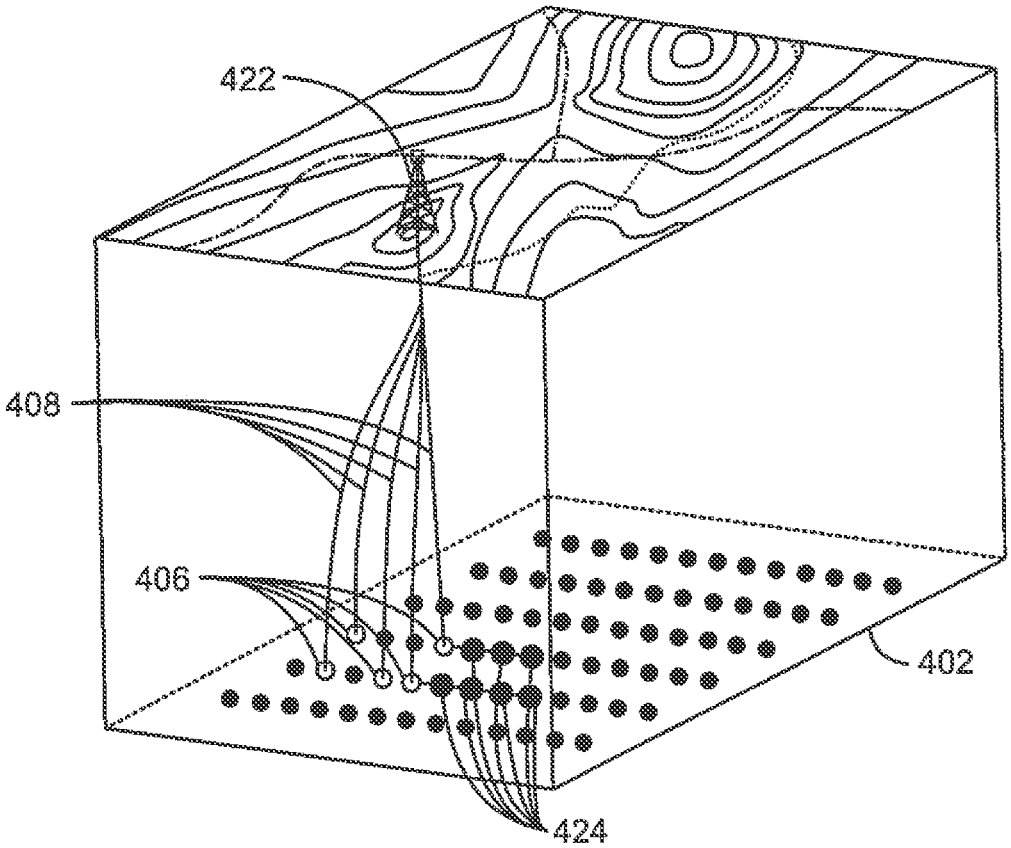
FIG. 4C is a schematic of a three-dimensional model of the hydrocarbon field including a final well site that may be generated according to embodiments described herein.

FIG. 4C is a schematic of a three-dimensional model 420 of the hydrocarbon field 402 including a final well site 422 that may be generated according to embodiments described herein. Like numbered items are as described with respect to FIGS. 4A and 4B. In various embodiments, the initial well site 404, the alternative well site 412, and any number of additional candidate well sites are compared, and the final well site 422 is selected from among the candidate well sites. For example, according to the embodiment shown in FIG. 4C, the initial well site 404 may be selected as the final well site 422.

Once the final well site 422 has been selected, the well site 422 may be evaluated for horizontal drilling opportunities.

Specifically, a number of additional reservoir targets 424 may be identified, and at least a portion of the well trajectories 408 may be extended such that the corresponding wells reach more than one reservoir target, as shown in FIG. 4C. In some embodiments, such horizontal drilling opportunities are considered after the final well site 422 has been determined. In other embodiments, the final well site 422 is selected based, at least in part, on the number of reservoir targets that are reachable by the wells of the candidate well sites.

Figure 5A:
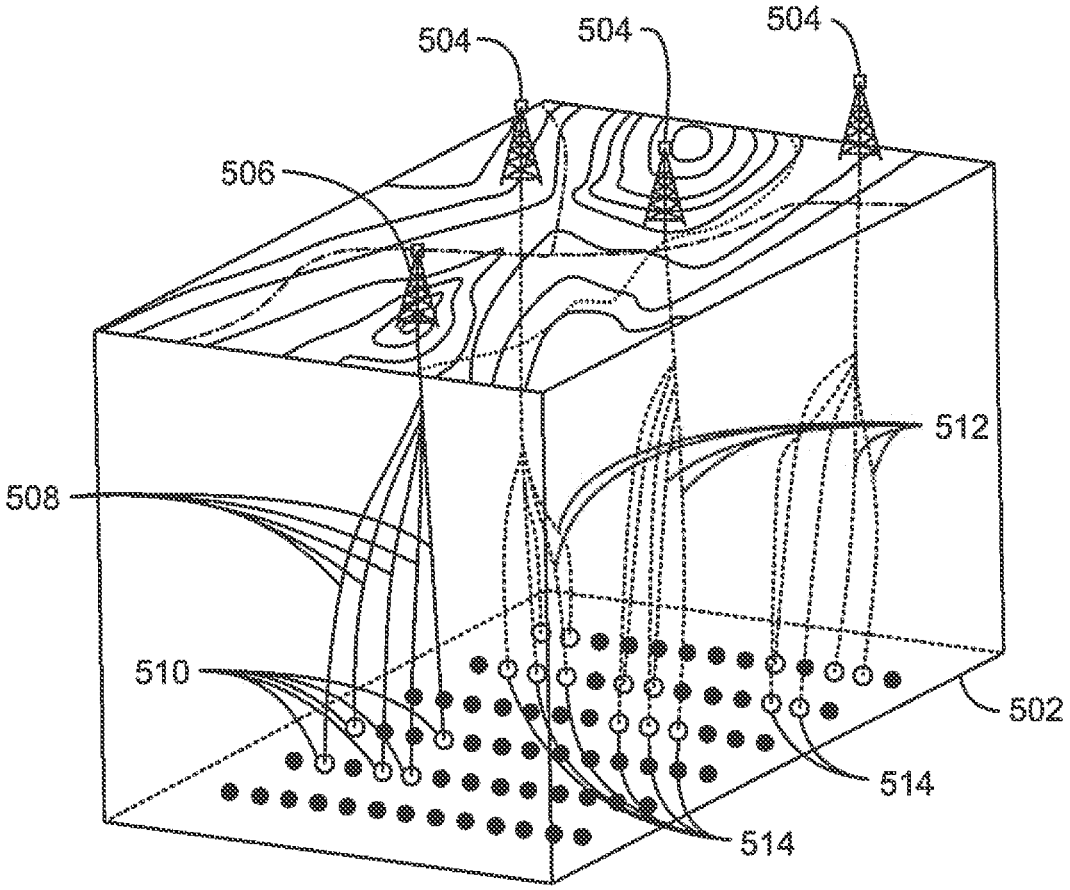
FIG. 5A is a schematic of a three-dimensional model of a hydrocarbon field including a number of existing well sties and an initial well site that may be generated according to embodiments described herein.

FIG. 5A is a schematic of a three-dimensional model 500 of a hydrocarbon field 502 including a number of existing well sties 504 and an initial well site 506 that may be generated according to embodiments described herein. The initial well site 506 may be designed such that anti-collision constraints relating to the exiting well sites 504 (as well as any number of additional engineering constraints) are satisfied. For example, well trajectories 508 for reservoir targets 510 associated with the initial well site 506 may be designed such that they do not interfere with well trajectories 512 for reservoir targets 514 associated with the existing well sites 504, since the wells for the existing well sites 504 have already been drilled and cannot be relocated easily.

Figure 5B:
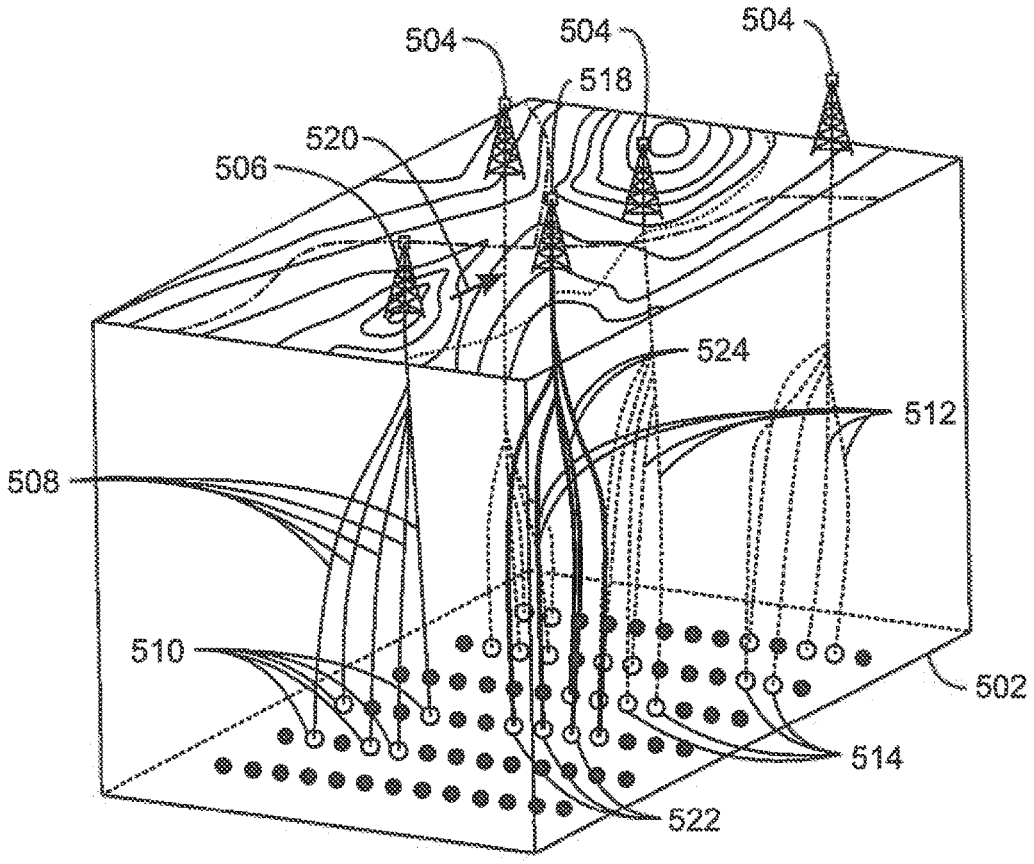
FIG. 5B is a schematic of a three-dimensional model of the hydrocarbon field including an alternative well site that may be generated instead of the initial well according to embodiments described herein.

FIG. 5B is a schematic of a three-dimensional model 516 of the hydrocarbon field 502 including an alternative well site 518 that may be generated instead of the initial well site 506 according to embodiments described herein. Like numbered items are as described with respect to FIG. 5A. As indicated by arrow 520, once the initial well site 506 has been designed, the user may opt to move the drill center location to another suitable surface area. At the newly selected drill center location, the previous selected reservoir targets 510 may be released, and new reservoir targets 522 may be automatically selected. In addition, a new well trajectory 524 may be determined for each new reservoir target 522 such that the anti-collision constraints (and the additional engineering constraints) are satisfied.

In various embodiments, the reservoir targets 522 for the well site 518 may be selected such that few, if any, undrilled reservoir targets are left within the hydrocarbon field 502. In particular, it may be desirable to avoid leaving undrilled reservoir targets in locations that may be difficult to reach later, such as between two well sites.

Methods for Interactively Planning a Well Site

Figure 6:
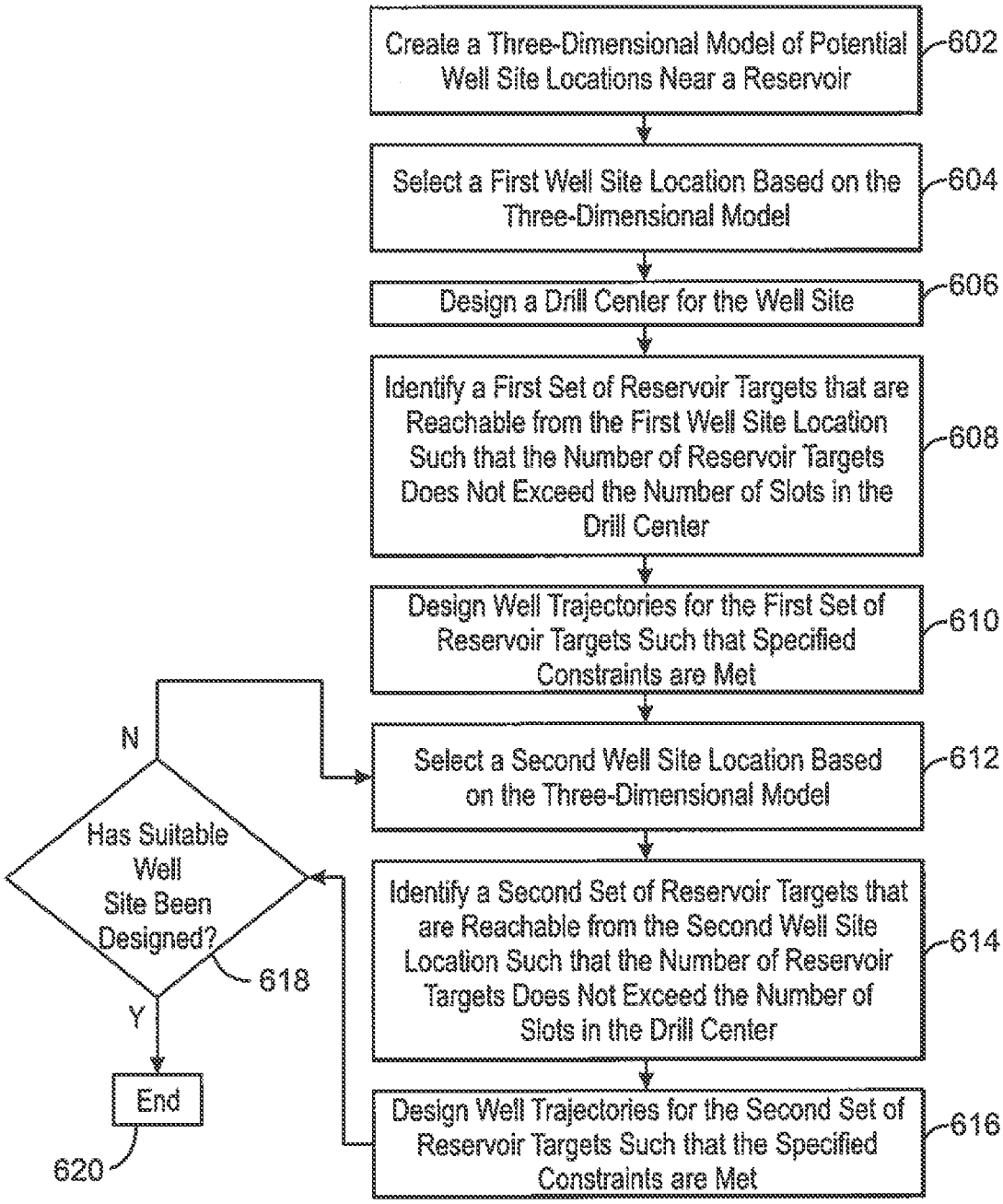
FIG. 6 is a process flow diagram of a method for dynamically planning a well site for the development of a hydrocarbon field.

FIG. 6 is a process flow diagram of a method 600 for interactively planning a well site for the development of a hydrocarbon field. The hydrocarbon field may include a reservoir from which hydrocarbons, e.g., oil and/or natural gas, are to be produced via a well site including a number of production wells. In various embodiments, the method 600 may be implemented by any suitable type of computing system, as discussed further with respect to FIG. 8. The method 600 may allow the user of the computing system to interactively plan the well site by designing multiple candidate well sites based on different well site locations and corresponding reservoir targets, comparing the candidate well sites, and selecting the candidate well site with the lowest cost and highest expected return.

The method begins at block 602 with the creation of a three-dimensional model of potential well site locations near a hydrocarbon reservoir. The three-dimensional model may include any suitable type of three-dimensional representation of the reservoir, as well as the surrounding geologic structures, topography, and surface features. For example, the three-dimensional model may include man-made objects, such as roads, underground pipelines, buildings, and the like, as well as objects that exist in nature, such as mountains, rivers, faults, and the like, that exist near the reservoir.

Once the three-dimensional model has been created, engineering constraints for planning the well site may be specified. Such engineering constraints may include constraints relating to the maximum number of slots to be included in the drill center, constraints relating to the maximum horizontal reach from the drill center to the reservoir targets, constraints relating to the minimum distance between the well trajectories and the ground objects to be avoided, and the like.

At block 604, a first well site location is selected based on the three-dimensional model. In various embodiments, the first well site location is selected in response to feedback from a user of the computing system. Specifically, the three-dimensional model may be displayed to the user via a user interface. The user interface may allow the user to drag an indicator across the three-dimensional model and drop the indicator over a desired well site location on the three-dimensional model. Further, in various embodiments, the user interface may prevent the user from dragging the indicator over locations that may not be used as well site locations. For example, if the three-dimensional model indicates that a mountain exists at one location, the computing system may determine that the location is not suitable for a well site location. Therefore, when the user attempts to drag the indicator over that location, the indicator may change colors or bounce off the location, for example, to notify the user that the location may not be selected for the well site. Other types of barriers that may be recognized include natural obstacles, such as rivers, canyons, gullies, and man-made obstacles, such as structures, highways, towns, cities, and the like. Further, information on land leases may be used to determine acceptable locations for drill sites, with the indicator prevented from stopping in an area that has no surface lease.

In some embodiments, the computing system provides a recommendation for the first well site location to the user via the user interface. The computing system may determine the recommendation for the first well site location based on optimization algorithms that take into account all of the specified engineering constraints. Further, in some embodiments, the computing system automatically determines the first well site location in response to input by the user. For example, the user may switch the computing system to automatic mode via the user interface, and the computing system may respond by automatically determining the first well site location based on the optimization algorithms.

At block 606, a drill center is designed for the well site. The drill center may include a number of slots arranged according to any number of different configurations, as discussed with respect to FIGS. 2A and 2B.

At block 608, a first set of reservoir targets that are reachable from the well site location is identified such that the number of reservoir targets does not exceed the number of slots in the designed drill center. In addition, at block 610, well trajectories for the first set of reservoir targets are designed such that specified constraints are met.

Once the well trajectories for the first set of reservoir targets have been designed, a second well site location is selected at block 612 based on the three-dimensional model. The user may select the second well site location by simply dragging the indicator to the new location via the user interface. At block 614, a first set of reservoir targets that are reachable from the well site location is identified such that the number of reservoir targets does not exceed the number of slots in the designed drill center. In addition, at block 616, well trajectories for the second set of reservoir targets are designed such that the specified constraints are met.

At block 618, it is determined whether a suitable well site has been designed. A suitable well site may be defined as a well site that is expected to provide at least a minimum specified return at less than or equal to a maximum specified cost. In various embodiments, the first well site location and corresponding well trajectories may be analyzed and compared to the second well site location and corresponding well trajectories. It may then be determined whether either well site location provides a suitable well site.

If a suitable well site has been designed, the method 600 ends at block 620. Otherwise, the method 600 returns to block 612, at which a third well site location is selected. This process may be repeated until a suitable well site has been designed. In various embodiments, this iterative process maximizes the utilization of all the selected reservoir targets, and minimizes the total cost of well site design.

The process flow diagram of FIG. 6 is not intended to indicate that the blocks of the method 600 are to be executed in any particular order, or that all of the blocks of the method 600 are to be included in every case. Further, any number of additional blocks not shown in FIG. 6 may be included within the method 600, depending on the details of the specific implementation.

Figure 7:
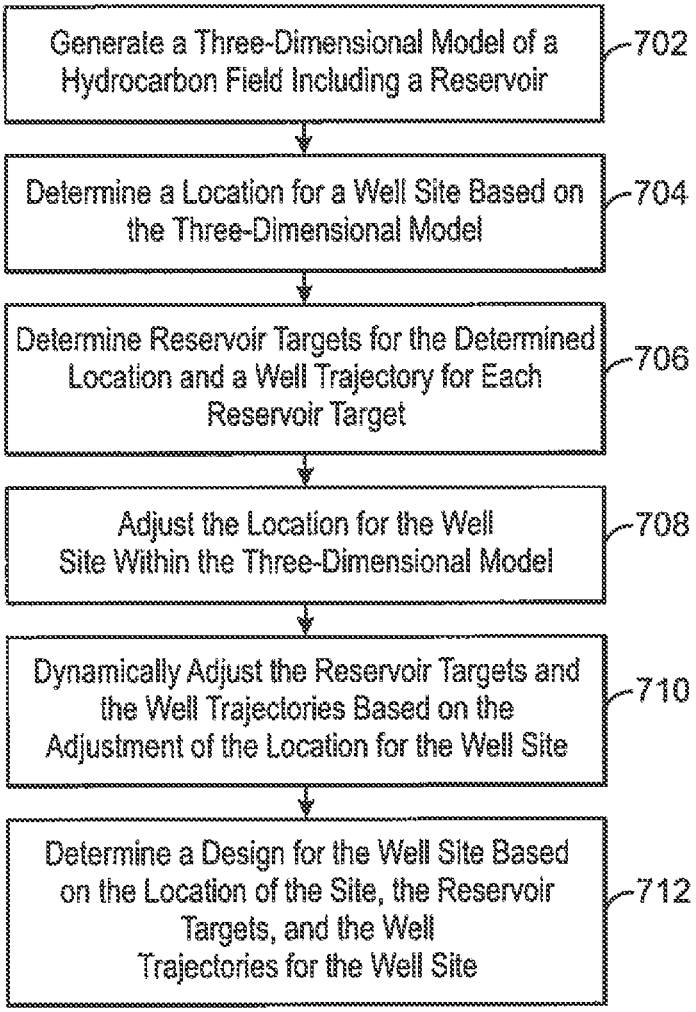
FIG. 7 is a generalized process flow diagram of a method for dynamically planning a well site.

FIG. 7 is a generalized process flow diagram of a method 700 for interactively planning a well site. The method 700 may be implemented by any suitable type of computing system, as discussed further with respect to FIG. 8. The method begins at block 702 with the generation of a three-dimensional model of a hydrocarbon field including a reservoir. The three-dimensional model may include a geologic structure and a topology of the hydrocarbon field. For example, the three-dimensional model may include representations of both man-made objects, such as roads, underground pipelines, buildings, and the like, and objects that exist in nature, such as mountains, rivers, faults, and the like, that are present in the hydrocarbon field.

At block 704, a location for a well site is determined based on the three-dimensional model. In various embodiments, the location for the well site is determined in response to feedback from a user of the computing system. Specifically, the three-dimensional model may be displayed to the user via a display device, and the user may provide feedback to the computing system via a user interface. The user interface may allow the user to select the location for the well site by moving an indicator over the three-dimensional model and placing the indicator on the desired location. Moreover, the user interface may disallow the indicator from moving over one or more locations represented by the three-dimensional model based on the geologic structure and the topology of the hydrocarbon field. In particular, the indicator may be prevented from moving over locations that include objects such as roads, underground pipeline, mountains, or the like, since such locations may not be suitable locations for the well site.

At block 706, reservoir targets for the determined location and a well trajectory for each reservoir target are determined. In various embodiments, the reservoir targets and corresponding well trajectories are automatically determined by the computing system based on the determined location for the well site. In addition, the reservoir targets may be determined, at least in part, based on a drill center of a specified configuration. Specifically, a specified number of reservoir targets that does not exceed a total number of slots in the drill center may be determined.

At block 708, the location for the well site is adjusted within the three-dimensional model. In various embodiments, the location for the well site is adjusted in response to feedback from the user of the computing system. For example, the user interface may allow the user to update the location for the well site by moving the indicator over the three-dimensional model and placing the indicator on a new location.

At block 710, the reservoir targets and the well trajectories are dynamically adjusted based on the adjustment of the location for the well site. In various embodiments, the reservoir targets and corresponding well trajectories are automatically updated by the computing system as the location for the well site is updated.

According to embodiments described herein, the location, reservoir targets, and well trajectories for the well site are determined and dynamically adjusted based on specified constraints. Such constraints may include constraints relating to a predefined maximum horizontal distance between the location for the well site and each reservoir target, and constraints relating to existing well sites in the hydrocarbon field. In addition, such constraints may include constraints relating to kick-off depths, hold distances, well trajectory types, dogleg severity, and the azimuth orientation of the well site, for example.

At block 712, a design for the well site is determined based on the location of the well site, the reservoir targets, and the well trajectories for the well site. Determining the design for the well site may include determining a final location for the well site, as well as final reservoir targets and well trajectories for the well site. In various embodiments, the design for the well site is determined such that a highest amount of hydrocarbons, e.g., oil and/or natural gas, is expected to be recovered from the reservoir at a lowest cost.

The process flow diagram of FIG. 7 is not intended to indicate that the blocks of the method 700 are to be executed in any particular order, or that all of the blocks of the method 700 are to be included in every case. Further, any number of additional blocks not shown in FIG. 7 may be included within the method 700, depending on the details of the specific implementation. For example, in various embodiments, determining and dynamically adjusting a well trajectory for a reservoir target includes performing horizontal drilling to extend the well trajectory to one or more additional reservoir targets. In this manner, the well site may be able to reach a larger number of reservoir targets without increasing the number of slots in the drill center.

Computing System for Dynamically Planning a Well Site

Figure 8:
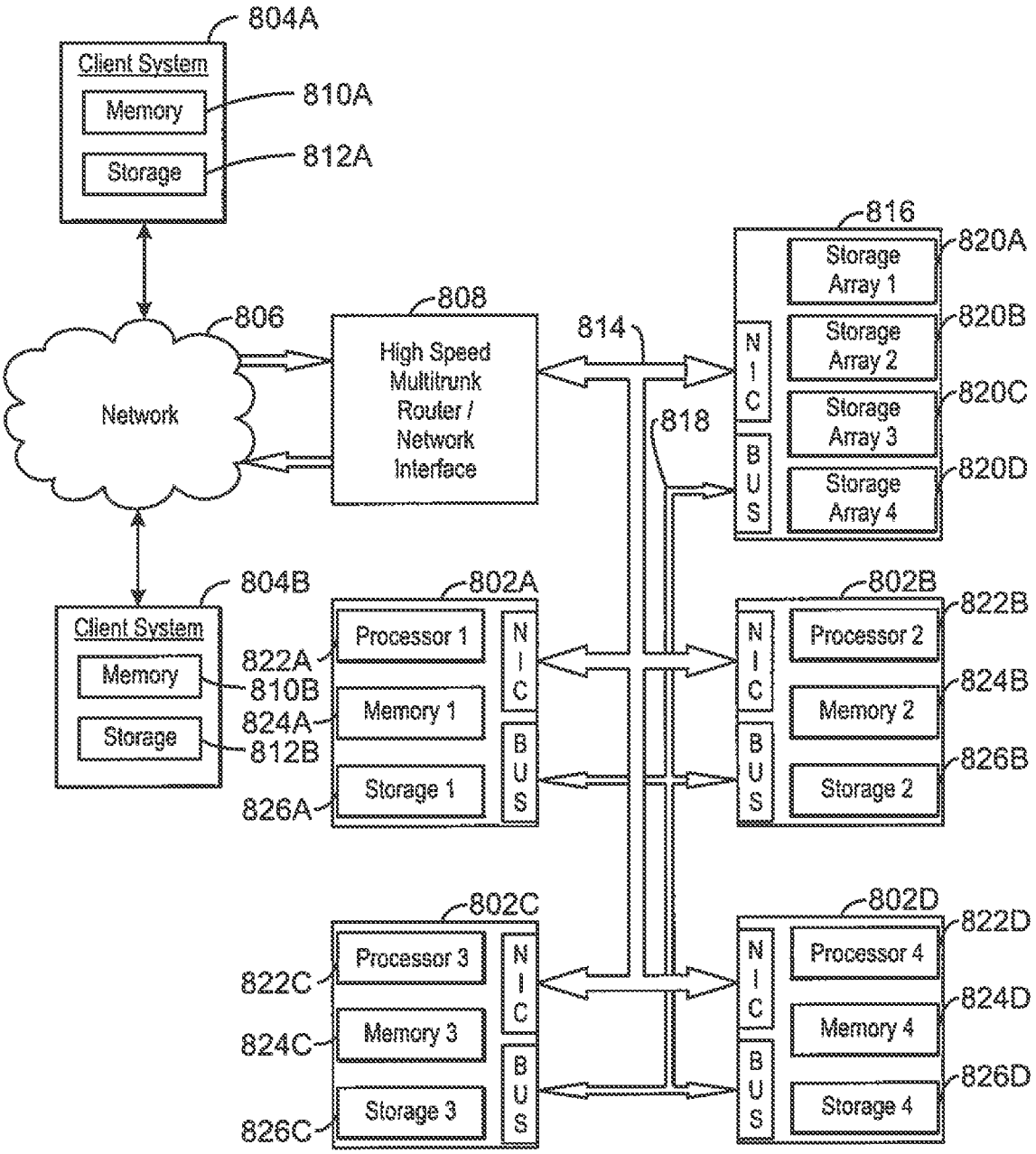
FIG. 8 is a block diagram of a cluster computing system that may be used to implement the dynamic well site planning process described herein.

FIG. 8 is a block diagram of a cluster computing system 800 that may be used to implement the dynamic well site planning process described herein. The cluster computing system 800 illustrated has four computing units 802A-D, each of which may perform calculations for a portion of the dynamic well site planning process. However, one of ordinary skill in the art will recognize that the cluster computing system 800 is not limited to this configuration, as any number of computing configurations may be selected. For example, a smaller analysis may be run on a single computing unit, such as a workstation, while a large finite element analysis calculation may be run on a cluster computing system 800 having tens, hundreds, thousands, or even more computing units.

The cluster computing system 800 may be accessed from any number of client systems 804A and 804B over a network 806, for example, through a high speed network interface 808. The computing units 802A-D may also function as client systems, providing both local computing support and access to the wider cluster computing system 800.

The network 806 may include a local area network (LAN), a wide area network (WAN), the Internet, or any combinations thereof. Each client system 804A and 804B may include one or more non-transitory, computer-readable media for storing the operating code and programs that are used to implement the dynamic well site planning process described herein. For example, each client system 804A and 804B may include a memory device 810A and 810B, which may include random access memory (RAM), read only memory (ROM), and the like. Each client system 804A and 804B may also include a storage device 812A and 812B, which may include any number of hard drives, optical drives, flash drives, or the like.

The high speed network interface 808 may be coupled to one or more buses in the cluster computing system 800, such as a communications bus 814. The communication bus 814 may be used to communicate instructions and data from the high speed network interface 808 to a cluster storage system 816 and to each of the computing units 802A-D in the cluster computing system 800. The communications bus 814 may also be used for communications among the computing units 802A-D and the cluster storage system 816. In addition to the communications bus 814, a high speed bus 818 can be present to increase the communications rate between the computing units 802A-D and/or the cluster storage system 816.

The cluster storage system 816 can have one or more non-transitory, computer-readable media, such as storage arrays 820A-D for the storage of three-dimensional models, data, visual representations, results, code, or other information, for example, concerning the implementation of and results from the methods 600 and 700 of FIGS. 6 and 7, respectively. The storage arrays 820A-D may include any combinations of hard drives, optical drives, flash drives, or the like.

Each computing unit 802A-D can have a processor 822A-D and associated local non-transitory, computer-readable media, such as a memory device 824A-D and a storage device 826A-D. Each processor 822A-D may be a multiple core unit, such as a multiple core central processing unit (CPU) or a graphics processing unit (GPU). Each memory device 824A-D may include ROM and/or RAM used to store code for directing the corresponding processor 822A-D to implement the methods 600 and 700 of FIGS. 6 and 7, respectively. Each storage device 826A-D may include one or more hard drives, optical drives, flash drives, or the like. In addition each storage device 826A-D may be used to provide storage for three-dimensional models, intermediate results, data, images, or code associated with operations, including code used to implement the methods 600 and 700 of FIGS. 6 and 7, respectively.

The present techniques are not limited to the architecture or unit configuration illustrated in FIG. 8. For example, any suitable processor-based device may be utilized for implementing all or a portion of embodiments of the dynamic well site planning process described herein, including without limitation personal computers, laptop computers, computer workstations, mobile devices, and multi-processor servers or workstations with (or without) shared memory. Moreover, embodiments may be implemented on application specific integrated circuits (ASICs) or very large scale integrated (VLSI) circuits. In fact, persons of ordinary skill in the art may utilize any number of suitable structures capable of executing logical operations according to the embodiments.

Embodiments

Embodiments of the invention may include any combinations of the methods and systems shown in the following numbered paragraphs. This is not to be considered a complete listing of all possible embodiments, as any number of variations can be envisioned from the description above.

1. A method for dynamically planning a well site, including:

generating, via a computing system, a three-dimensional model of a hydrocarbon field including a reservoir;

determining a location for a well site based on the three-dimensional model;

determining reservoir targets for the determined location and a well trajectory for each reservoir target;

adjusting the location for the well site based on the three-dimensional model;

dynamically adjusting the reservoir targets and the well trajectories based on the adjustment of the location for the well site, wherein the determination and the dynamic adjustment of the location, the reservoir targets, and the well trajectories for the well site are based on specified constraints; and determining a design for the well site based on the location of the well site, the reservoir targets, and the well trajectories for the well site.

2. The method of paragraph 1, including determining and dynamically adjusting the location for the well site in response to feedback from a user of the computing system.

3. The method of paragraph 2, including:

displaying the three-dimensional model to the user via a display device; and receiving the feedback from the user via a user interface.

4. The method of paragraph 3, wherein receiving the feedback from the user via the user interface includes determining and dynamically adjusting the location for the well site as the user moves an indicator over the three-dimensional model.

5. The method of paragraph 4, wherein the three-dimensional model includes a geologic structure and a topology of the hydrocarbon field, and wherein determining and dynamically adjusting the location for the well site based on the specified constraints includes disallowing the indicator from moving over one or more locations represented by the three-dimensional model based on the geologic structure and the topology of the hydrocarbon field.

6. The method of any of paragraphs 1 and 2, including determining the reservoir targets for the determined location based on a drill center of a specified configuration by determining a specified number of reservoir targets that does not exceed a total number of slots in the drill center.

7. The method of any of paragraphs 1, 2, and 6, wherein determining and dynamically adjusting the location, the reservoir targets, and the well trajectories for the well site based on the specified constraints includes determining the location, the reservoir targets, and the well trajectories based on anti-collision constraints relating to existing well sites.

8. The method of any of paragraphs 1, 2, 6, and 7, wherein determining and dynamically adjusting the location, the reservoir targets, and the well trajectories for the well site based on the specified constraints includes determining the location, the reservoir targets, and the well trajectories based on constraints relating to a predefined maximum horizontal distance between the location for the well site and each reservoir target.

9. The method of any of paragraphs 1, 2, and 6-8, wherein determining and dynamically adjusting a well trajectory for a reservoir target includes performing horizontal drilling to extend the well trajectory to one or more additional reservoir targets.

10. The method of any of paragraphs 1, 2, and 6-9, including automatically determining or automatically adjusting the reservoir targets and the well trajectories for the well site via the computing system.

11. A computing system for dynamically planning a well site, including:

a processor;

a storage medium, including:

a three-dimensional model of a hydrocarbon field including a reservoir; and specified constraints for planning a well site at the hydrocarbon field; and a non-transitory, computer-readable medium including code configured to direct the processor to:

dynamically determine a location for the well site based on the three-dimensional model and the specified constraints in response to feedback from a user of the computing system;

dynamically determine reservoir targets for the well site based on the three-dimensional model and the specified constraints in response to the dynamic determination of the location for the well site;

dynamically determine a well trajectory for each reservoir target based on the three-dimensional model and the specified constraints; and determine a design for the well site based on the dynamic determination of the location, the reservoir targets, and the well trajectories for the well site in response to feedback from the user.

12. The computing system of paragraph 11, wherein the non-transitory, computer-readable medium includes code configured to direct the processor to dynamically determine the location, the reservoir targets, and the well trajectories for the well site by interactively updating the location, the reservoir targets, and the well trajectories for the well site in response to the feedback from the user.

13. The computing system of any of paragraphs 11 and 12, wherein the non-transitory, computer-readable medium includes code configured to direct the processor to automatically determine the reservoir targets and the well trajectories for the well site based on the location for the well site.

14. The computing system of any of paragraphs 11-13, including a display device configured to:

display the three-dimensional model to the user; and receive the feedback from the user via a user interface.

15. The computing system of paragraph 14, wherein the display device is configured to receive the feedback from the user via the user interface in response to the user moving an indicator over the three-dimensional model.

16. The computing system of paragraph 15, wherein the three-dimensional model includes a geologic structure and a topology of the hydrocarbon field, and wherein the non-transitory, computer-readable medium includes code configured to direct the processor to disallow the indicator from moving over one or more locations represented by the three-dimensional model based on the geologic structure and the topology of the hydrocarbon field.

17. The computing system of any of paragraphs 11-14, wherein the non-transitory, computer-readable medium includes code configured to direct the processor to dynamically determine the reservoir targets for the well site based, at least in part, on a drill center of a specified configuration by determining a specified number of reservoir targets that does not exceed a total number of slots in the drill center.

18. The computing system of any of paragraphs 11-14 and 17, wherein the specified constraints include anti-collision constraints relating to existing well sites in the hydrocarbon field.

19. The computing system of any of paragraphs 11-14, 17, and 18, wherein the specified constraints include constraints relating to a predefined maximum horizontal distance between the location for the well site and each reservoir target.

20. The computing system of any of paragraphs 11-14 and 17-19, wherein the well trajectories for the reservoir targets include deviated well trajectories.

21. The computing system of any of paragraphs 11-14 and 17-20, wherein the non-transitory, computer-readable medium includes code configured to direct the processor to dynamically determine a well trajectory for a reservoir target by performing horizontal drilling to extend the well trajectory to one or more additional reservoir targets.

22. The computing system of any of paragraphs 11-14 and 17-21, wherein the non-transitory, computer-readable medium includes code configured to direct the processor to determine the design for the well site such that a highest amount of hydrocarbons is expected to be recovered from the reservoir at a lowest cost.

23. A non-transitory, computer-readable storage medium for storing computer-readable instructions, the computer-readable instructions including code configured to direct a processor to:

generate a three-dimensional model of a hydrocarbon field including a reservoir;

display the three-dimensional model to a user via a display device;

determine a location for a well site based on the three-dimensional model in response to feedback from a user;

automatically determine reservoir targets for the determined location based on a drill center of a specified configuration;

automatically determine a well trajectory for each reservoir target;

update the location for the well site within the three-dimensional model in response to feedback from the user;

automatically update the reservoir targets and the well trajectories as the location for the well site is updated, wherein the location, the reservoir targets, and the well trajectories for the well site are determined and updated based, at least in part, on specified constraints; and determine a design for the well site based on the determination and updating of the location, the reservoir targets, and the well trajectories for the well site.

24. The non-transitory, computer-readable storage medium of paragraph 23, wherein the computer-readable instructions include code configured to direct the processor to receive the feedback from the user via a user interface in response to the user moving an indicator over the three-dimensional model.

25. The non-transitory, computer-readable storage medium of paragraph 24, wherein the three-dimensional model includes a geologic structure and a topology of the hydrocarbon field, and wherein the computer-readable instructions include code configured to direct the processor to disallow the indicator from moving over one or more locations represented by the three-dimensional model based on the geologic structure and the topology of the hydrocarbon field.

26. The non-transitory, computer-readable storage medium of any of paragraphs 23 and 24, wherein the specified constraints include anti-collision constraints relating to existing well sites in the hydrocarbon field.

27. The non-transitory, computer-readable storage medium of any of paragraphs 23, 24, and 26, wherein the specified constraints include constraints relating to a predefined maximum horizontal distance between the location for the well site and each reservoir target.

28. The non-transitory, computer-readable storage medium of any of paragraphs 23, 24, 26, and 27, wherein the computer-readable instructions include code configured to direct the processor to determine a well trajectory for a reservoir target by performing horizontal drilling to extend the well trajectory to one or more additional reservoir targets.

29. The non-transitory, computer-readable storage medium of any of paragraphs 23, 24, and 26-28, wherein the computer-readable instructions include code configured to direct the processor to determine the design for the well site such that a highest amount of hydrocarbons is expected to be recovered from the reservoir at a lowest cost.

While the present techniques may be susceptible to various modifications and alternative forms, the embodiments discussed above have been shown only by way of example. However, it should again be understood that the techniques is not intended to be limited to the particular embodiments disclosed herein. Indeed, the present techniques include all alternatives, modifications, and equivalents falling within the true spirit and scope of the appended claims.

What is claimed is:

1. A method for dynamically planning a well site, comprising:

generating, via a computing system, a three-dimensional model of a hydrocarbon field comprising a reservoir, wherein the three-dimensional model comprises a geologic structure and a topology of the hydrocarbon field;

determining a first location for a well site based on the three-dimensional model;

determining a configuration for a drill center for the well site, wherein the drill center configuration is determined prior to selection of reservoir targets;

determining, based on the determined drill center configuration, a first set of reservoir targets for the determined first location, wherein the number of reservoir targets in the first set of reservoir targets does not exceed the number of slots in the determined drill center configuration;

determining a well trajectory for a well from each slot in the drill center for each of the first set of reservoir targets;

displaying, via a user interface, the three-dimensional model comprising the first well site and first set of reservoir targets and well trajectories for each of the first set of reservoir targets;

allowing a user to interactively adjust, via the user interface, the first location and select a second location for a well site based on the three-dimensional model by moving an indicator over the three-dimensional model, wherein the user interface allows the user to drag the indicator across the three-dimensional model and drop the indicator over a desired well site location on the three-dimensional model and wherein the user interface prevents the user from dragging the indicator over locations that are not suitable for a well site based on the geologic structure and topology of the hydrocarbon field;

dynamically adjusting, via a computing system, the reservoir targets and the well trajectories based on the adjustment of the location for the well site to the second location wherein the dynamically adjusting comprises:

automatically adjusting model parameters in a simulation that involve the reservoir targets, the well trajectories, the drill center configuration, and the location for the well site as the user changes the well site location; and automatically displaying changes to the reservoir targets and the well trajectories in the three-dimensional model in a real-time fashion as the user changes the well site location via a display device;

determining whether a design for a suitable well site has been designed, wherein the determination is based at least in part on comparing the first well site location and corresponding well trajectories to the second well site location and corresponding well trajectories;

evaluating the design for the suitable well site, wherein the evaluating comprises identifying one or more additional reservoir targets and determining whether one or more of the well trajectories in the design for the suitable well site can be horizontally extended to reach the one or more additional reservoir targets;

displaying the suitable well site, the reservoir targets, and the well trajectories of the design; and causing one or more wells to be drilled in the hydrocarbon field based on the design for the suitable well site.

2. The method of claim 1, wherein dynamically adjusting the reservoir targets and the well trajectories for the well site based on the adjustment of the location for the well site to the second location comprises satisfying anti-collision constraints relating to existing well sites.

3. The method of claim 1, wherein dynamically adjusting the reservoir targets and the well trajectories for the well site based on the adjustment of the location for the well site to the second location comprises satisfying constraints relating to a predefined maximum horizontal distance between the location for the well site and each reservoir target.

4. The method of claim 1, comprising automatically determining or automatically adjusting the reservoir targets and the well trajectories for the well site via the computing system.

5. The method of claim 1, wherein the user interface disallows the indicator from moving over one or more locations represented by the three-dimensional model based on anti-collision constraints relating to existing well sites in the hydrocarbon field.

6. The method of claim 1, wherein the user interface disallows the indicator from moving over one or more locations represented by the three-dimensional model based on constraints relating to a predefined maximum horizontal distance between the location for the well site and each reservoir target.

7. The method of claim 1, wherein determining the design for the suitable well site comprises determining which of the first well site location and corresponding well trajectories and the second well site location and corresponding well trajectories is expected to provide a higher amount of hydrocarbons recovery from the reservoir at a lowest cost.

8. The method of claim 1, wherein the indicator of the user interface changes colors or bounces off of a location when the user attempts to drag the indicator over a location that is not suitable for a well site.

* * * * *